US008225454B2

(12) United States Patent
Yang et al.

(10) Patent No.: US 8,225,454 B2
(45) Date of Patent: Jul. 24, 2012

(54) MOP DISC AND FABRIC FRAME FIXATION STRUCTURE

(75) Inventors: Mei Ling Yang, Keelung (TW); Yang Bo Yi, Keelung (TW); Mike Chen, Keelung (TW)

(73) Assignee: MacKay Electronic Co., Ltd., Keelung (TW)

( * ) Notice: Subject to any disclaimer, the term of this patent is extended or adjusted under 35 U.S.C. 154(b) by 0 days.

(21) Appl. No.: 13/089,511

(22) Filed: Apr. 19, 2011

(65) Prior Publication Data

US 2011/0271472 A1 Nov. 10, 2011

(30) Foreign Application Priority Data

May 7, 2010 (TW) ..... 99208515 U

(51) Int. Cl.
*A47L 13/20* (2006.01)

(52) U.S. Cl. ..... 15/229.6; 15/145; 15/229.1; 15/229.2

(58) Field of Classification Search ..... 15/147.1, 15/147.2, 229.1, 229.2, 229.6, 145
See application file for complete search history.

(56) References Cited

U.S. PATENT DOCUMENTS 5,207,754 A * 5/1993 Harrah ..... 15/147.1
2011/0258799 A1* 10/2011 Wu ..... 15/229.1

* cited by examiner

*Primary Examiner* — Randall Chin
(74) *Attorney, Agent, or Firm* — Alan Kamrath; Kamrath IP Lawfirm, PA

(57) ABSTRACT

A mop disc and fabric frame fixation structure includes a fabric frame including cotton strips at the bottom of the fabric frame, a noncircular embedding concave surface at the top of the fabric frame, latch bumps formed in the corresponding embedding concave surface and protruded upwardly, and a concave latch surface concavely formed on at least one side of the latch bump. A disc is embedded into the embedding concave surface and has a latch groove in the corresponding embedding concave surface. Each latch groove is arranged apart from the other. A latch block is formed on an internal wall of the latch groove and protrudes from the corresponding concave latch surface. Thus, the disc is embedded into the embedding concave surface, and the concave latch surface and the latch block are latched with each other, to combine the fabric frame to the disc.

2 Claims, 4 Drawing Sheets

MOP DISC AND FABRIC FRAME FIXATION STRUCTURE

BACKGROUND OF THE INVENTION

1. Field of the Invention

The present invention relates to a mop disc and fabric frame fixation structure and, in particular, to the structure that facilitates changing a fabric frame.

2. Description of the Related Art

A mop is an indispensable tool used for cleaning and mopping the floor, and a traditional mop usually includes a rod and a plurality of fabric strips coupled to the bottom of the rod. In the connection between the fabric strips and the rod, a concave groove with an internal thread is formed in a clamping base at the tip of the fabric strips and provided for coupling the fabric strips to a threaded surface at the bottom of the rod to fix the fabric strips to the rod and prevent the fabric strips from being separated from the rod. After the mop has been used for a while, the fabric strips may be worn out or damaged, and a replacement is needed. At present, there is a mop and a water bucket that can be used for dewatering the mop by centrifugal forces and is characterized in that users no longer need to dry the mop by twisting the fabric strips by hand anymore. Particularly, the fabric strips are simply placed in a rotating filter on the internal side of the water bucket, such that the centrifugal force produced by the rotation of the filter can spin off the water in the fabric strips to dry the mop. However, it is also required to replace the fabric strips of this sort from time to time when they are worn or damaged.

SUMMARY OF THE INVENTION

In view of the aforementioned shortcomings of the conventional dewatering bucket, a mop disc and fabric frame fixation structure of the present invention overcome the shortcomings of the prior art.

Therefore, it is a primary objective of the present invention to provide a mop disc and fabric frame fixation structure that facilitates changing a fabric frame.

To achieve the foregoing objective, the present invention provides a mop disc and fabric frame fixation structure. The fabric frame comprises cotton strips installed at the bottom of the fabric frame, a noncircular embedding concave surface formed at the top of the fabric frame, a plurality of latch bumps formed in the embedding concave surface and protruded upwardly, and a concave latch surface concavely formed on at least one side of the latch bump. A disc has a top end coupled to a mop handle and a bottom end embedded into the embedding concave surface of the fabric frame. A latch groove is formed at the bottom of the disc and corresponding to the fabric frame embedding concave surface. Each latch bump is arranged with an interval apart from the other. A latch block is formed on an internal side of the latch groove and opposite to the concave latch surface. Thus, the disc can be embedded into the embedding concave surface of the fabric frame, the latch bump and the latch groove are latched, and the concave latch surface and the latch block are latched to combine the fabric frame with the mop disc.

DETAILED DESCRIPTION OF THE PREFERRED EMBODIMENTS

To make it easier to understand the technical characteristics and measures of the present invention to achieve the aforementioned objects and effects, preferred embodiments with related drawings for the detailed description of the present invention follows.

Figure 1:
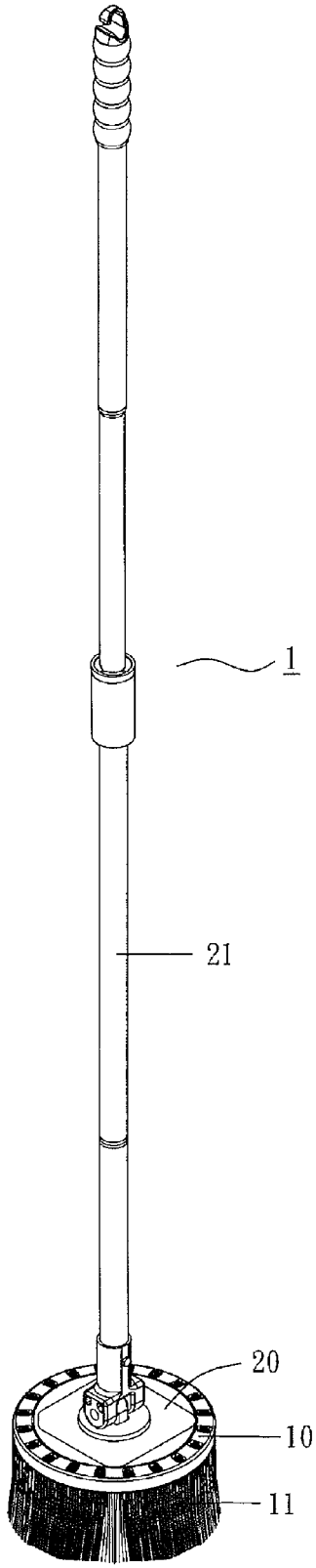
FIG. 1 is a perspective view of a preferred embodiment of the present invention.
Figure 2:
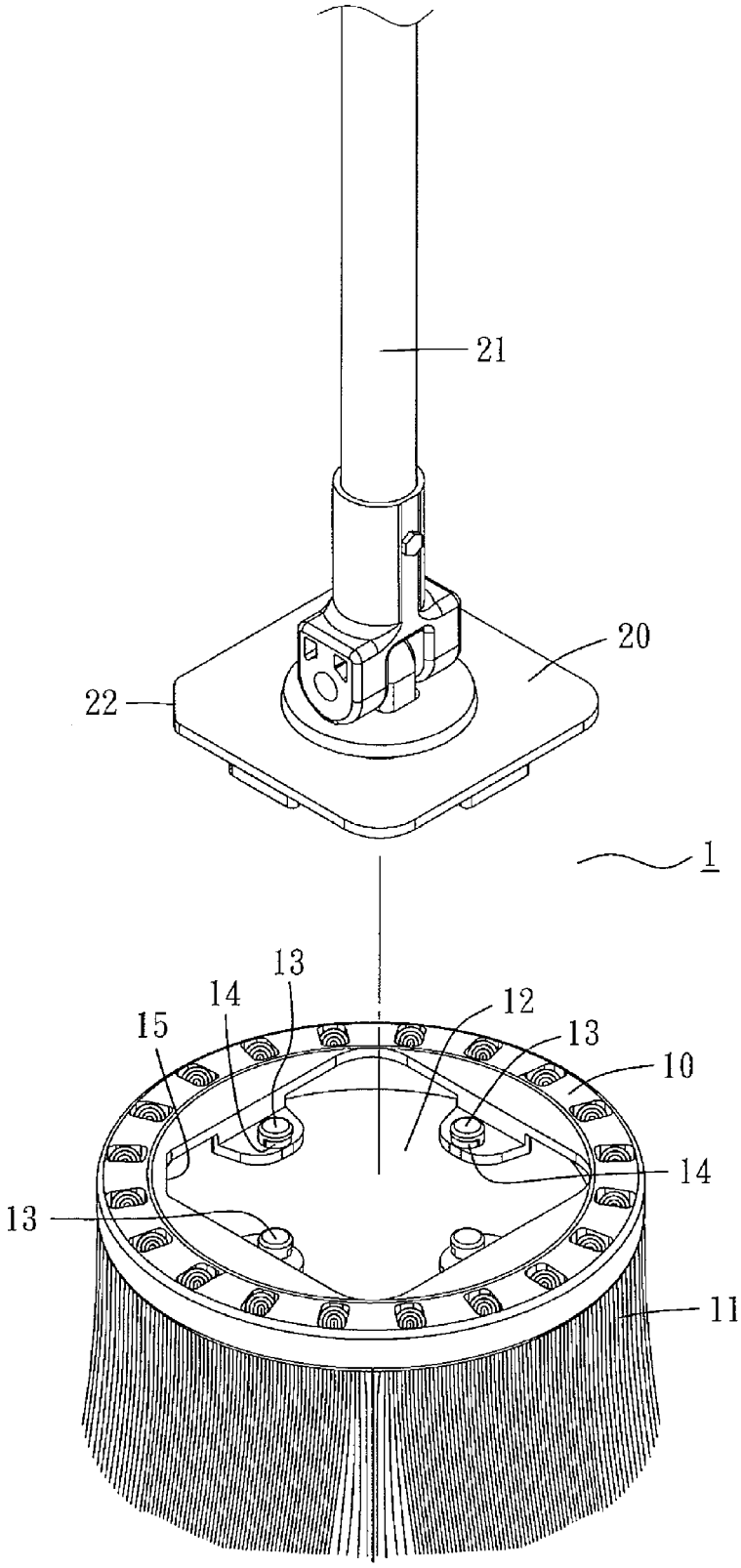
FIG. 2 is an exploded view of a preferred embodiment of the present invention.
Figure 3:
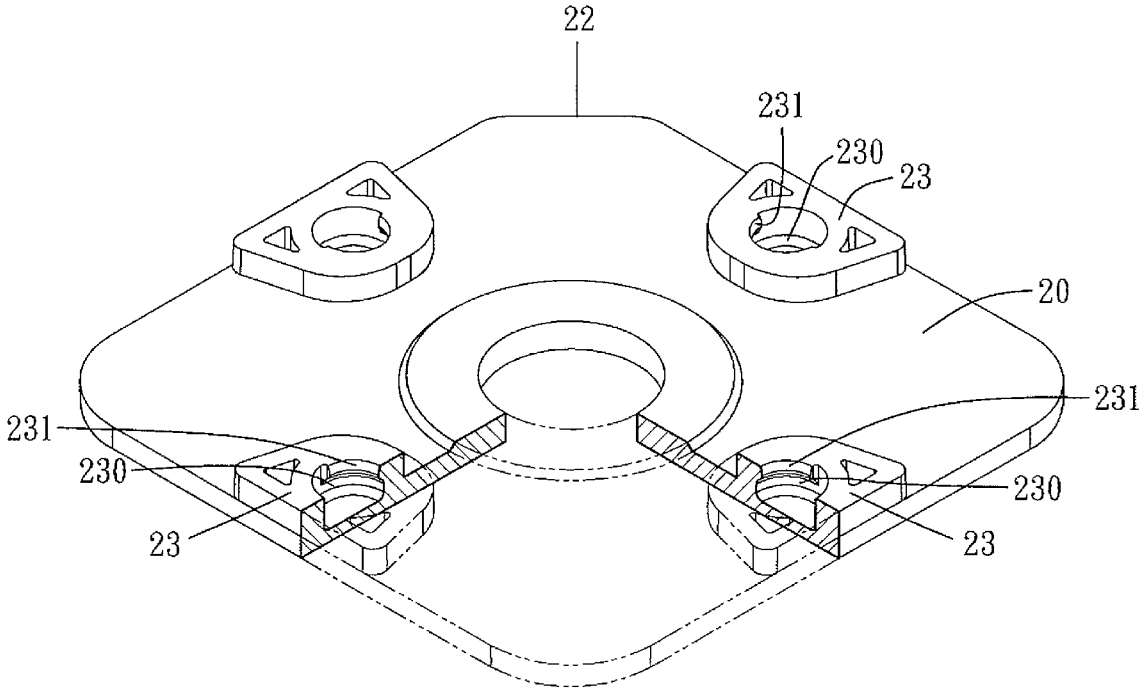
FIG. 3 is a bottom view of a mop disc in accordance with a preferred embodiment of the present invention.

With reference to FIGS. 1 to 3, the present invention comprises: a fabric frame 10 having cotton strips 11 installed at the bottom of the fabric frame 10, a noncircular embedding concave surface 12 formed at the top of the fabric frame 10, a plurality of latch bumps 13 formed in the embedding concave surface 12 and protruded upwardly, a concave latch surface 14 concavely formed on at least one side of the latch bump 13, and a foolproof bevel lap surface 15 (or a foolproof device) disposed at a corner of the embedding concave surface 12 (which is situated at the included angle of the embedding concave surface 12).

A disc 20 (as shown in FIG. 3) is embedded into the embedding concave surface 12 of the fabric frame 10. The disc 20 has a top end for coupling a mop handle 21 and a foolproof retaining surface 22 (or a foolproof device) disposed at a corner corresponding to the lap surface 15 of the fabric frame 10. The bottom of the disc 20 has a latch base 23 with a latch groove 230 at the middle and separated from the corresponding latch bump 13 of the embedding concave surface 12. A latch block 231 protrudes from the internal wall of the latch groove 230 and corresponds to the concave latch surface 14 of the fabric frame 10. The disc 20 can be embedded into the embedding concave surface 12 of the fabric frame 10, the latch bump 13 and the latch groove 230 are latched, and the concave latch surface 14 and the latch block 231 are latched to combine the fabric frame 10 with the mop disc 20.

Figure 4:
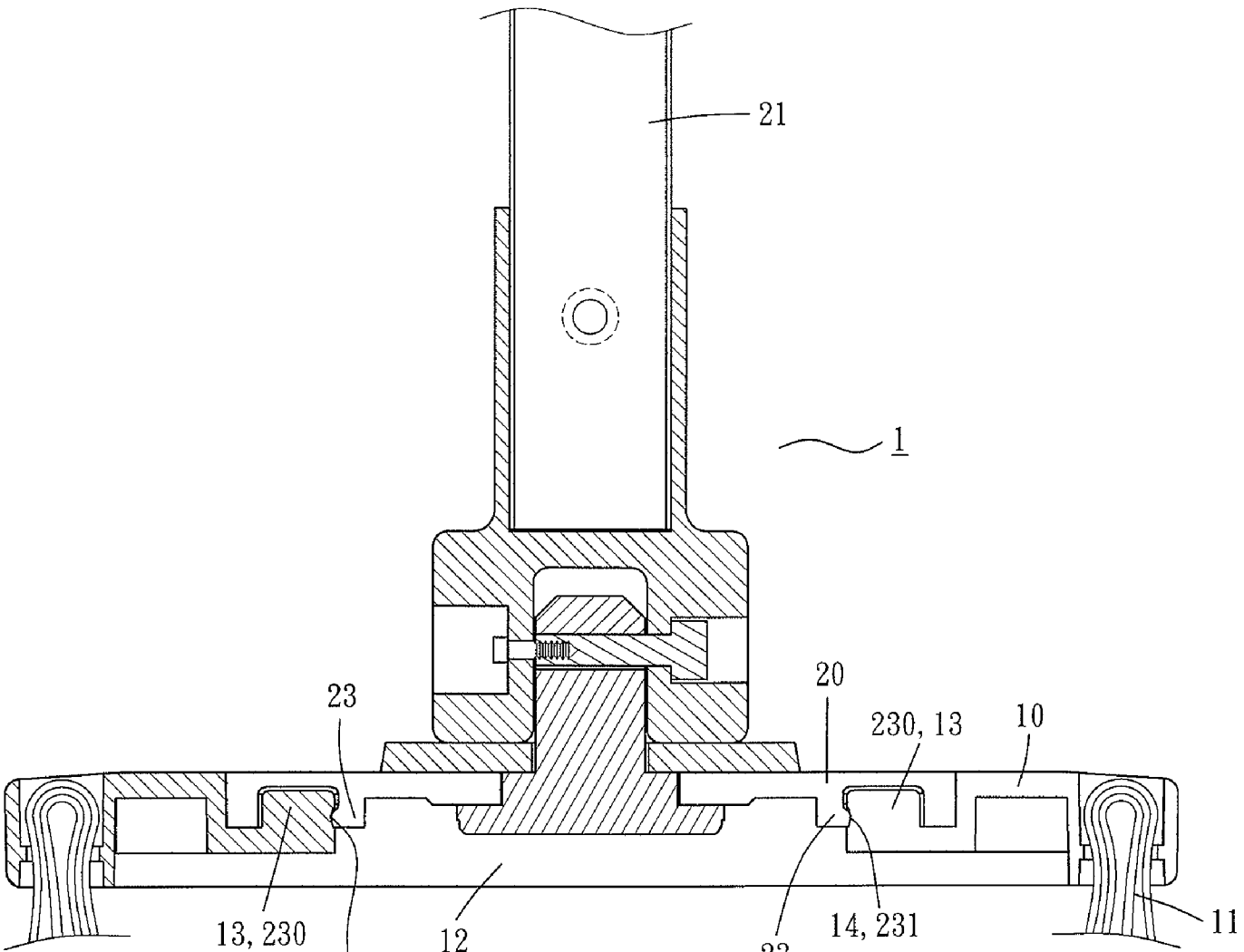
FIG. 4 is a cross-sectional view of a preferred embodiment of the present invention.

In FIGS. 2 and 4, during the assembling process, the retaining surface 22 of the disc 20 is aligned with the lap surface 15 of the fabric frame 10. Then, the disc 20 is embedded into the embedding concave surface 12 of the fabric frame 10, the latch groove 230 of the disc 20 is embedded into the latch bump 13 of the fabric frame 10 correspondingly, and the latch block 231 of the latch groove 230 and the concave latch surface 14 of the latch bump 13 of the fabric frame 10 are embedded vertically with each other. Thus, the disc 20 and the fabric frame 10 can be connected securely to form a mop 1.

If it is necessary to replace the old cotton strips 11, a user fixes the fabric frame 10 (such by stepping on the fabric frame 10) to shake the mop handle 21 and its disc 20 sideway to separate the latch block 231 of the disc 20 from the concave latch surface 14 to further separate the latch bump 13 from the latch groove 230. Thus, the old fabric frame 10 will be separated from the disc 20. Then, the user combines the fabric frame 10 with the cotton strips 11 to the disc 20 according to the aforementioned method to produce a mop 1.

Since the latch block 231 of the latch groove 230 is made of plastic and elastic, the latch block 231 can be latched into the concave latch surface 14 of the latch bump 13 to couple the fabric frame 10 with the disc 20 securely. If it is necessary to replace the cotton strips 11, users simply fix the fabric frame 10 (by stepping on the fabric frame 10) and then shake the mop handle 21 and its disc 20 sideway to separate the latch block 231 of the disc 20 from the concave latch surface 14 of the fabric frame 10 to lift the mop handle 21, to separate the latch bump 13 from the latch groove 230 and separate the fabric frame 10 from the disc 20 to replace the fabric frame 10 having the cotton strips 11.

In summation of the description above, the present invention improves over the prior art.

What is claimed is:

1. A mop disc and fabric frame fixation structure, comprising:

a fabric frame including a plurality of cotton strips installed at a bottom surface of the fabric frame, a noncircular embedding concave surface formed at a top surface of the fabric frame, a plurality of latch bumps formed in the non-circular embedding concave surface and protruded upwardly, and a concave latch surface concavely formed on at least one side of each latch bump; and a disc embedded into the embedding concave surface of the fabric frame, with the disc having a mop handle coupled to a top end of the disc, and a plurality of latch grooves coupled to the plurality of latch bumps of the fabric frame, with a latch block formed on an internal wall of each latch groove and protruded into the corresponding concave latch surface of the latch bump, with the concave latch surface and the latch block latched with each other to combine the fabric frame to the disc.

2. The mop disc and fabric frame fixation structure as recited in claim 1, further comprising a foolproof bevel lap surface formed at a corner of the embedding concave surface of the fabric frame, and a foolproof bevel retaining surface formed at the foolproof bevel lap surface, with the foolproof bevel lap surface and the bevel retaining surface providing a guiding direction for a user to assemble the disc and the fabric frame.

* * * * *